US005710530A

United States Patent [19]

Wada et al.

[11] Patent Number: 5,710,530

[45] Date of Patent: Jan. 20, 1998

[54] TM DUAL MODE DIELECTRIC RESONATOR APPARATUS AND METHODS FOR ADJUSTING COUPLING COEFFICIENT AND RESONANCE FREQUENCIES THEREOF

[75] Inventors: Hidekazu Wada, Ibaraki; Toru Kurisu, Kyoto; Shin Abe, Mukou, all of Japan

[73] Assignee: Murata Manufacturing Co. Ltd., Kyoto, Japan

[21] Appl. No.: 636,913

[22] Filed: Apr. 24, 1996

Related U.S. Application Data

[63] Continuation of Ser. No. 339,542, Nov. 15, 1994, abandoned.

[30] Foreign Application Priority Data

Nov. 18, 1993 [JP] Japan ..... 5-314224

[51] Int. Cl.[6] ..... H01P 7/10

[52] U.S. Cl. ..... 333/219.1; 333/235

[58] Field of Search ..... 333/202, 219.1, 333/235

[56] References Cited

U.S. PATENT DOCUMENTS

| | | | |
|---|---|---|---|
| 4,642,591 | 2/1987 | Kobayashi | 333/227 |
| 5,078,621 | 1/1992 | Nishikawa et al. | 439/581 |
| 5,336,112 | 8/1994 | Michishita et al. | 439/581 |

FOREIGN PATENT DOCUMENTS

| | | |
|---|---|---|
| 2723040 | 12/1977 | Germany . |
| 63-313901 | 12/1988 | Japan . |
| 1-77008 | 5/1989 | Japan . |
| 4-339401 | 11/1992 | Japan . |
| 1599917 | 10/1990 | U.S.S.R. . |

OTHER PUBLICATIONS

1992 IEEE MTT-S International Microwave Symposium Digest, vol. 3, Jun. 1-5, 1992, Albuquerque, US; IEEE, New York, 1992, pp. 1617-1620 "800 MHz High Power Duplexer Using TM Dual Mode Dielectric Resonators" by Y. Ishikawa et al., p. 1617, left col., lines 1-20, Fig. 1.

Patent Abstracts Of Japan, vol. 17, no 61 (E-1316) 5 Feb. 1993 & JP-A-04 267 604 (Hitachi Ferrite Ltd.) 24 Sep. 1992.

Patent Abstracts Of Japan, vol. 9, No. 280 (E-356) (2003) 8 Nov. 1985 & JP-A-60 123 106 (Nippon Denki K.K.) 1 Jul. 1985.

*Primary Examiner*—Robert Pascal
*Assistant Examiner*—Barbara Summons
*Attorney, Agent, or Firm*—Ostrolenk, Faber, Gerb & Soffen, LLP

[57] ABSTRACT

In a TM dual mode dielectric resonator apparatus including a cross-shaped TM dual mode dielectric resonator provided in an electrically conductive case, the cross-shaped dielectric resonator being comprised of first and second dielectric resonators, mode coupling means such as at least one groove or the like for coupling an operation of the first dielectric resonator with that of the second dielectric resonator is formed in the TM dual mode dielectric resonator. At least one first projection of a dielectric material for adjusting a coupling coefficient between the two dielectric resonators is formed on a portion of the crossing portion, wherein an adjustment amount of the coupling coefficient when the first projection is removed is previously determined. Further, respective at least one second and third projections of dielectric materials for adjusting resonance frequencies of the first and second dielectric resonators are formed respectively in a portion of the first dielectric resonator other than the crossing portion and in another portion of the second dielectric resonator other than the crossing portion.

17 Claims, 4 Drawing Sheets

TM DUAL MODE DIELECTRIC RESONATOR APPARATUS AND METHODS FOR ADJUSTING COUPLING COEFFICIENT AND RESONANCE FREQUENCIES THEREOF

This is a continuation of application Ser. No. 08/339,542 filed on Nov. 15, 1994, now abandoned.

BACKGROUND OF THE INVENTION

1. Field of the Invention

The present invention relates to a dielectric resonator apparatus and methods for respectively adjusting a coupling coefficient and a resonance frequency of a dielectric resonator apparatus, and in particular, a TM dual mode dielectric resonator apparatus and methods for respectively adjusting a coupling coefficient between two dielectric resonators of a TM dual mode dielectric resonator apparatus and respective resonance frequencies of the two dielectric resonators thereof.

2. Description of the Related Art

FIG. 1 shows a conventional TM dual mode resonator apparatus 1 comprising a cross-shaped TM dual mode resonator 2, which is disclosed in the Japanese patent Laid-open publication No. 63-313901.

Referring to FIG. 1, in the conventional TM dual mode resonator apparatus 1, there is provided or mounted the TM dual mode resonator 2 within an electrically conductive case 3 which functions as a waveguide. The TM dual mode resonator 2 is made of a dielectric ceramic material, and is constituted by integrally forming two TM mode rectangular-parallelepiped-shaped dielectric resonators 4A and 4B in a cross shape so that the longitudinal direction of the dielectric resonator 4A is perpendicular to that of the dielectric resonator 4B. Further, electrically conductive layers (not shown) such as Ag thick films or the like are formed on both end surfaces of the respective dielectric resonators 4A and 4B, the conductive layers are soldered onto inner surfaces of the case 3 so as to be electrically connected thereto. In a crossing portion of the two dielectric resonators 4A and 4B (referred to as a crossing portion hereinafter) formed in a cross shape, coupling grooves 5 for coupling an operation mode of the dielectric resonator 4A with that of the dielectric resonator 4B are formed so as to have longitudinal lengths each from the front surface of the dielectric resonators 4A and 4B to the back surface thereof, and so as to have depths each extending from two corners of the crossing portion which oppose each other toward the center of the crossing portion in a diagonal direction of the crossing portion.

FIG. 2 shows:

(a) electric lines $E_1$ and $E_2$ of force of the respective dielectric resonators 4A and 4B parallel to respective longitudinal directions thereof which are indicated by alternate long and short dash lines;

(b) electric lines Ee of force of the even mode extending from the left end of the dielectric resonator 4B through the crossing portion of the two dielectric resonators 4A and 4B to the top end of the dielectric resonator 4A and vice versa, and also extending from the bottom end of the dielectric resonator 4A through the crossing portion to the right end of the dielectric resonator 4B and vice versa, which are indicated by dotted lines; and (c) the other electric lines Eo of force of the odd mode extending from the right end of the dielectric resonator 4B through the crossing portion to the top end of the dielectric resonator 4A and vice versa, and also extending from the bottom end of the dielectric resonator 4A through the crossing portion to the left end of the dielectric resonator 4B and vice versa, which are indicated by solid lines, wherein the electric lines $E_1$ of force are generated by the dielectric resonator 4A, the electric lines $E_2$ of force are generated by the dielectric resonator 4B, and the electric lines Ee and Eo are generated in the TM dual mode dielectric resonator 2 shown in FIG. 1.

As shown in FIG. 2, since the two grooves 5 are formed in the two corners opposing each other in a diagonal direction of the crossing portion of the TM dual mode dielectric resonator 2, the effective dielectric constant in the odd mode in which the electric lines Eo of force pass through the grooves 5 is different from that in the even mode in which the electric lines Ee of force pass through a portion where no groove 5 is formed, and then a coupling is caused between the operation modes of the two dielectric resonators 4A and 4B.

The characteristics of such a TM dual mode dielectric resonator 2 include:

(a) respective resonance frequencies of the two dielectric resonators 4A and 4B; and (b) a coupling coefficient between both the dielectric resonators 4A and 4B.

Conventionally, in order to adjust the respective resonance frequencies of the dielectric resonators 4A and 4B, a cutting amount is adjusted when cutting a portion of a side surface of each of the dielectric resonators 4A and 4B in or near the ends thereof, which is other than the crossing portion which both the electric lines $E_1$ and $E_2$ of force pass through, so as to cut the electric lines $E_1$ or $E_2$ of force, such as a portion 100 of the side surface shown in FIG. 2 in the case of adjusting the resonance frequency of the dielectric resonator 4A, an end portion of each of the respective dielectric resonators 4A and 4B, or the like. On the other hand, in order to adjust the coupling coefficient between the dielectric resonators 4A and 4B, the depths of the grooves 5 are adjusted by cutting the bottom portions thereof so as to cut a portion of the crossing portion, such as a portion 101 shown in FIG. 2.

Upon calculation of the respective resonance frequencies of the dielectric resonators 4A and 4B and the coupling coefficient therebetween, these parameters can be calculated based on measurement values of two peak frequencies of the frequency characteristics, two peak return losses and loaded Qs through a network analyzer measurement, using conventional calculation processes which are publicly known to those skilled in the art.

In other words, conventionally, as described above, when adjusting the coupling coefficient, the bottom portions of the grooves 5 are cut so as to cut both the electric lines $E_1$ and $E_2$ of force using an analog cutting process. On the other hand, when adjusting the resonance frequencies of the two dielectric resonators 4A and 4B, respective portions of the dielectric resonators 4A and 4B other than the crossing portion are cut so as to cut the respective electric lines $E_1$ and $E_2$, respectively, using another analog cutting process.

In these adjusting processes, the above-mentioned portion of the TM dual mode dielectric resonator 2 is slightly cut, and then the resonance frequencies are measured. This process is repeated so as to obtain a desirable coupling coefficient and/or desirable resonance frequencies. That is, a so-called cut-and-try method is used when adjusting the coupling coefficient and the resonance frequencies. In this case, there is such a problem that it takes a long time to adjust the coupling coefficient and the resonance frequencies.

SUMMARY OF THE INVENTION

An object of the present invention is therefore to provide a TM dual mode dielectric resonator apparatus in which the coupling coefficient between two dielectric resonators thereof and the resonance frequencies thereof are capable of being adjusted in a time shorter than that of the conventional apparatus.

Another object of the present invention is to provide methods for respectively adjusting a coupling coefficient between two dielectric resonators of a TM dual mode dielectric resonator apparatus, and the resonance frequencies thereof, in a time shorter than that of the conventional apparatus.

In order to achieve the aforementioned objective, according to one aspect of the present invention, there is provided a dielectric resonator apparatus comprising:

an electrically conductive case;

a cross-shaped TM dual mode dielectric resonator provided in said case, said TM dual mode dielectric resonator comprising first and second dielectric resonators integrally formed so as to be perpendicular to each other;

mode coupling means for coupling an operation mode of said first dielectric resonator with an operation mode of said second dielectric resonator, formed in said TM dual mode dielectric resonator; and at least one first projection of a dielectric material for adjusting a coupling coefficient between the first and second dielectric resonators, formed on a portion of the crossing portion of the first and second dielectric resonators, an adjustment amount of the coupling coefficient when said first projection is removed being previously determined.

In the above-mentioned apparatus, a plurality of first projections are preferably formed so that respective adjustment amounts of the coupling coefficients of said first projections are set to be substantially the same as each other.

In the above-mentioned apparatus, a plurality of first projections are preferably formed so that an adjustment amount of the coupling coefficient of said one first projection is set to be substantially integral multiple of that of another first projection.

According to another aspect of the present invention, there is provided a dielectric resonator apparatus comprising:

an electrically conductive case;

a cross-shaped TM dual mode dielectric resonator provided in said case, said TM dual mode dielectric resonator comprising first and second dielectric resonators integrally formed so as to be perpendicular to each other;

mode coupling means for coupling an operation mode of said first dielectric resonator with an operation mode of said second dielectric resonator, formed in said TM dual mode dielectric resonator;

at least one first resonance frequency adjustment projection of a dielectric material for adjusting a resonance frequency of the first dielectric resonator, formed in a portion of the first dielectric resonator other than the crossing portion of the first and second dielectric resonators where electric lines of force of the first dielectric resonator pass, an adjustment amount of the resonance frequency of the first dielectric resonator when said first resonance frequency adjustment projection is removed being previously determined; and at least one second resonance frequency adjustment projection of a dielectric material for adjusting a resonance frequency of the second dielectric resonator, formed in a portion of the second dielectric resonator, other than the crossing portion of the first and second dielectric resonators where electric lines of force of the second dielectric resonator pass, an adjustment amount of the resonance frequency of the second dielectric resonator when said second resonance frequency adjustment projection is removed being previously determined.

In the above-mentioned apparatus, a plurality of first resonance frequency adjustment projections are preferably formed so that respective adjustment amounts of the resonance frequencies of said first resonance frequency adjustment projections are set to be substantially the same as each other, and wherein a plurality of second resonance frequency adjustment projections are preferably formed so that respective adjustment amounts of the resonance frequencies of said second resonance frequency adjustment projections are set to be substantially the same as each other.

In the above-mentioned apparatus, a plurality of first resonance frequency adjustment projections are preferably formed so that an adjustment amount of the resonance frequency of one first resonance frequency adjustment projection is set to be substantially an integral multiple of that of another first resonance frequency adjustment projection, and wherein a plurality of second resonance frequency adjustment projections are preferably formed so that an adjustment amount of the resonance frequency of one second resonance frequency adjustment projection is set to be substantially an integral multiple of that of another second resonance frequency adjustment projection.

According to a still further aspect of the present invention, there is provided a method for adjusting a coupling coefficient between first and second dielectric resonators of a cross-shaped TM dual mode dielectric resonator of a dielectric resonator apparatus, said cross-shaped TM dual mode dielectric resonator provided in an electrically conductive case, said TM dual mode dielectric resonator comprising the first and second dielectric resonators integrally formed so as to be perpendicular to each other, wherein said apparatus comprises:

mode coupling means for coupling an operation mode of said first dielectric resonator with an operation mode of said second dielectric resonator, formed in said TM dual mode dielectric resonator;

at least one first projection of a dielectric material for adjusting a coupling coefficient between the first and second dielectric resonators, formed on a portion of the crossing portion of the first and second dielectric resonators, an adjustment amount of the coupling coefficient when said first projection is removed being previously determined, wherein said method includes a step of removing said at least one first projection, thereby adjusting the coupling coefficient between the first and second dielectric resonators.

In the above-mentioned method, a plurality of first projections are preferably formed so that respective adjustment amounts of the coupling coefficients of said first projections are set to be substantially the same as each other.

In the above-mentioned method, a plurality of first projections are preferably formed so that an adjustment amount of the coupling coefficient of said one first projection is set to be substantially an integral multiple of that of another first projection.

According to a still more further aspect of the present invention, there is provided a method for adjusting resonance frequencies of first and second dielectric resonators of a cross-shaped TM dual mode dielectric resonator of a dielectric resonator apparatus, said cross-shaped TM dual mode dielectric resonator provided in an electrically conductive case, said TM dual mode dielectric resonator comprising the first and second dielectric resonators integrally formed so as to be perpendicular to each other, wherein said apparatus comprises:

mode coupling means for coupling an operation mode of said first dielectric resonator with an operation mode of said second dielectric resonator, formed in said TM dual mode dielectric resonator;

at least one first resonance frequency adjustment projection of a dielectric material for adjusting a resonance frequency of the first dielectric resonator, formed in a portion of the first dielectric resonator other than the crossing portion of the first and second dielectric resonators where electric lines of force of the first dielectric resonator pass, an adjustment amount of the resonance frequency of the first dielectric resonator when said first resonance frequency adjustment projection is removed being previously determined; and at least one second resonance frequency adjustment projection of a dielectric material for adjusting a resonance frequency of the second dielectric resonator, formed in a portion of the second dielectric resonator, other than the crossing portion of the first and second dielectric resonators where electric lines of force of the second dielectric resonator pass, an adjustment amount of the resonance frequency of the second dielectric resonator when said second resonance frequency adjustment projection is removed being previously determined, wherein said method includes the following steps:

removing said at least one first resonance frequency adjustment projection, thereby adjusting the resonance frequency of the first dielectric resonator, and removing said at least one second resonance frequency adjustment projection, thereby adjusting the resonance frequency of the second dielectric resonator.

In the above-mentioned method, a plurality of first resonance frequency adjustment projections are preferably formed so that respective adjustment amounts of the resonance frequencies of said first resonance frequency adjustment projections are set to be substantially the same as each other, and wherein a plurality of second resonance frequency adjustment projections are preferably formed so that respective adjustment amounts of the resonance frequencies of said second resonance frequency adjustment projections are set to be substantially the same as each other.

In the above-mentioned method, a plurality of first resonance frequency adjustment projections are preferably formed so that an adjustment amount of the resonance frequency of one first resonance frequency adjustment projection is set to be substantially an integral multiple of that of another first resonance frequency adjustment projection, and wherein a plurality of second resonance frequency adjustment projections are preferably formed so that an adjustment amount of the resonance frequency of one second resonance frequency adjustment projection is set to be substantially an integral multiple of that of another second resonance frequency adjustment projection.

According to the present invention, the coupling coefficient between the first and second dielectric resonators and/or the resonance frequencies of the two dielectric resonators can be easily adjusted by predetermined adjustment amounts by respectively cutting out or removing one or more projections for adjusting the coefficients and one or more projections for adjusting the resonance frequencies in units of the projections.

In particular, the adjustment amounts of the respective projections are preferably set to be substantially the same as each other, respectively, or the adjustment amount of the projection is preferably set to be substantially an integral multiple of that of another projection. In this case, the coupling coefficient between the first and second dielectric resonators and/or the resonance frequencies of the two dielectric resonators can be easily adjusted by digital amounts.

According to the present invention, the above-mentioned cut-and-try method in which the adjustment and measurement of the resonance frequencies and the coupling coefficient are repeated is not required. This results in decrease in the number of processes of the adjusting procedures for adjusting the coupling coefficient and the resonance frequencies, and also in reduction in the time required for adjusting the same.

BRIEF DESCRIPTION OF THE DRAWINGS

These and other objects and features of the present invention will become clear from the following description taken in conjunction with the preferred embodiments thereof with reference to the accompanying drawings in which like parts are designated by like reference numerals, which may not be described in all figures in which they appear and in which.

DETAILED DESCRIPTION OF THE PREFERRED EMBODIMENTS

The preferred embodiments according to the present invention will be described below with reference to the attached drawings.

Figure 1:
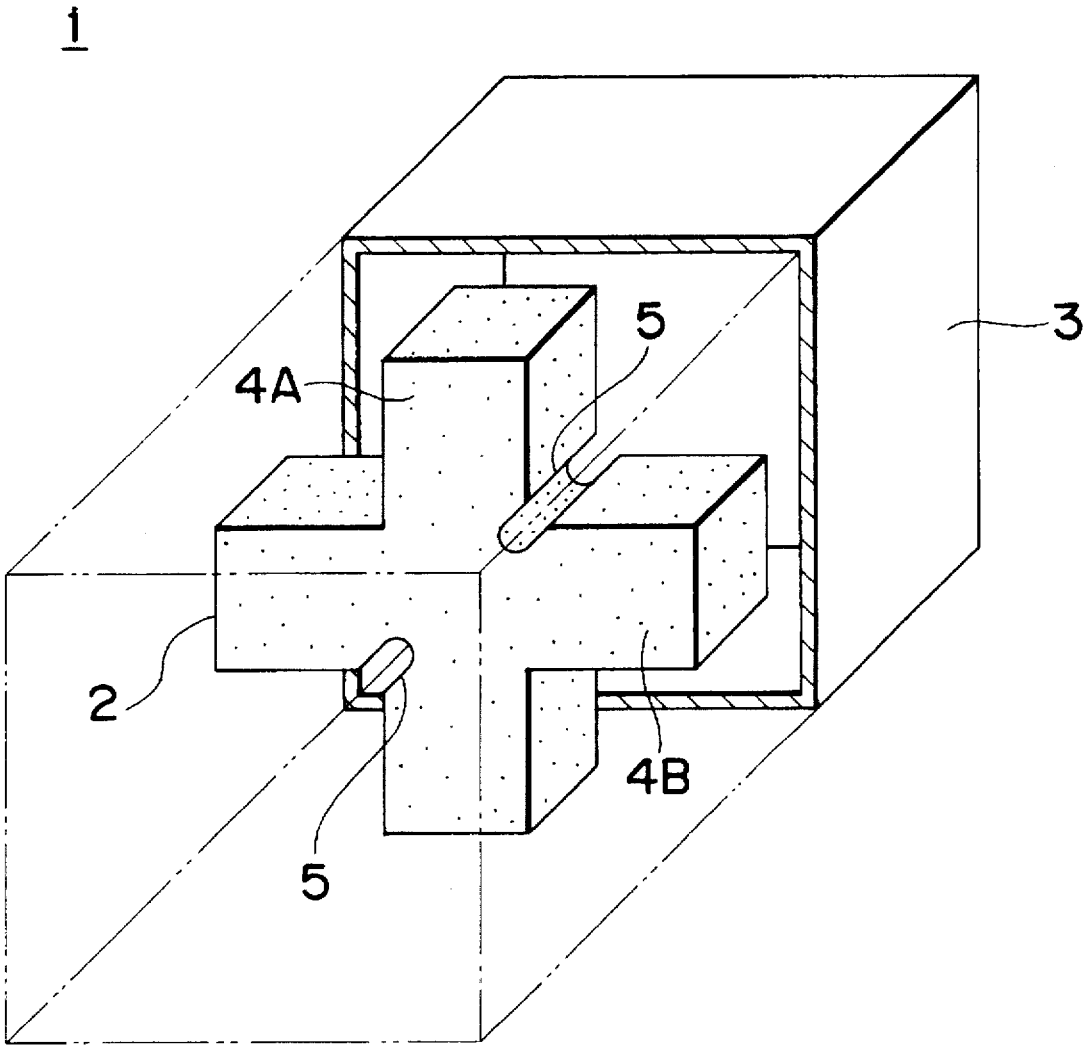
Fig. 1 PRIOR ART
FIG. 1 is a partially broken perspective view of a conventional TM dual mode resonator apparatus comprising a TM dual mode resonator.
Figure 2:
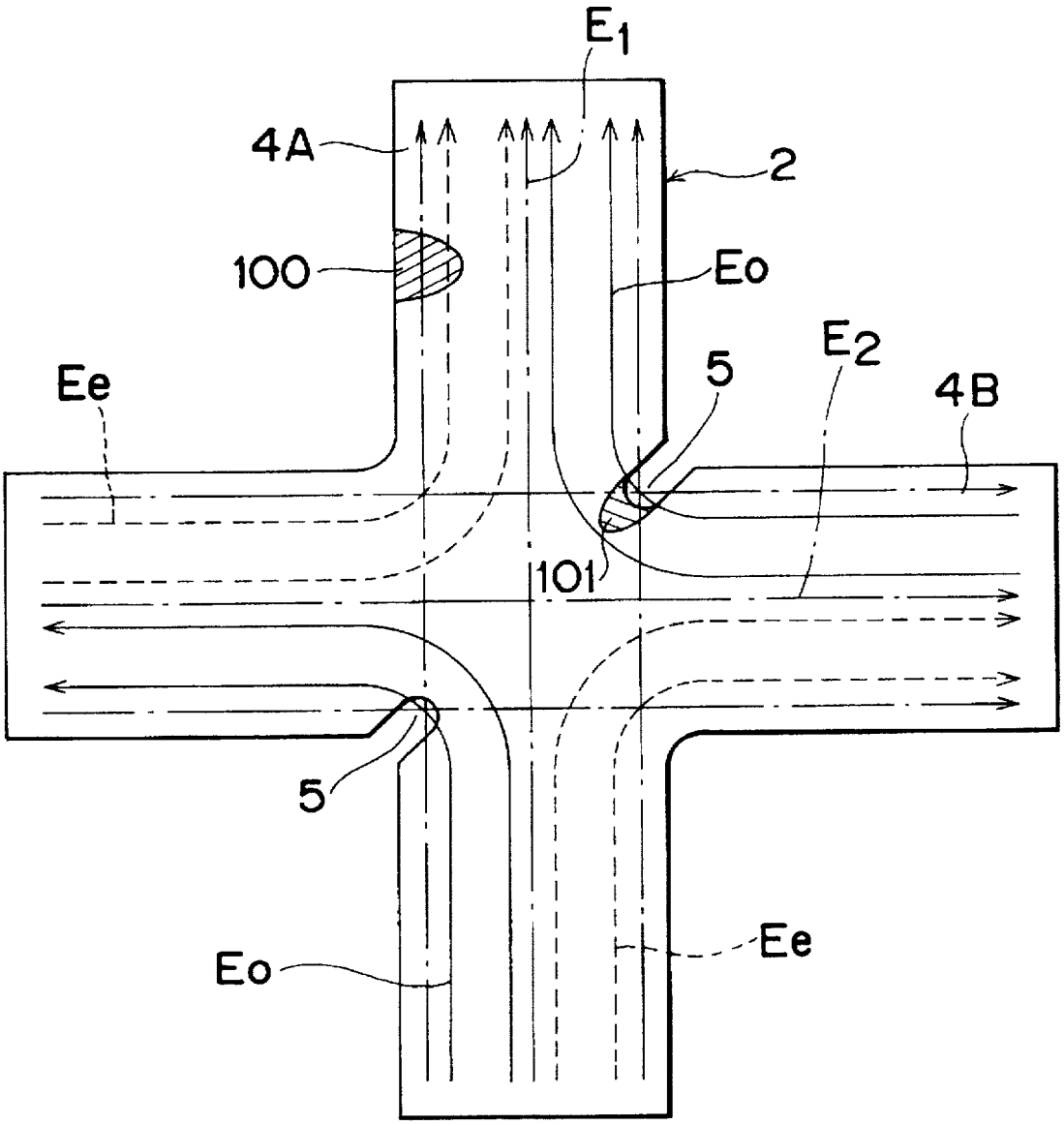
Fig. 2 PRIOR ART
FIG. 2 is a front view of a TM dual mode resonator of the conventional TM dual mode resonator apparatus, showing a conventional method for adjusting a coupling coefficient between two dielectric resonators of TM dual mode resonator shown in FIG. 1, and a method for adjusting resonance frequencies of two dielectric resonators of the TM dual mode resonator shown in FIG. 1.
Figure 3:
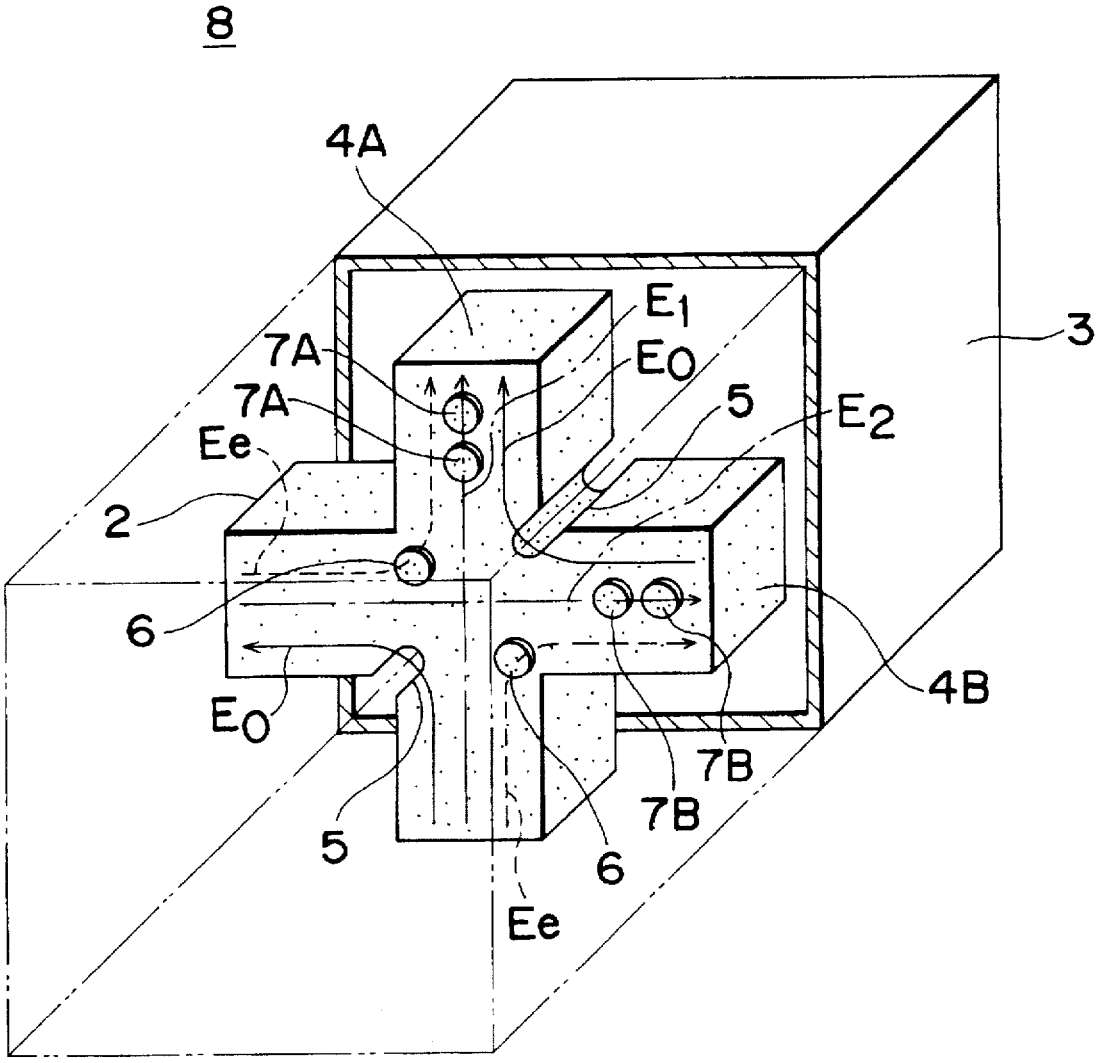
FIG. 3 is a partially broken perspective view of a TM dual mode resonator apparatus according to a preferred embodiment of the present invention.

FIG. 3 is a partially broken perspective view of a cross-shaped TM dual mode resonator apparatus 8 according to a preferred embodiment of the present invention.

Referring to FIG. 3, in the TM dual mode resonator apparatus 8, there is provided or mounted a TM dual mode resonator 2 within an electrically conductive case 3 which functions as a waveguide. The TM dual mode resonator 2 is made of a dielectric ceramic material, and is constituted by integrally forming two TM mode rectangular-parallelepiped-shaped dielectric resonators 4A and 4B in a cross shape so that the longitudinal direction of the dielectric resonator 4A is perpendicular to that of the dielectric resonator 4B. Further, electrically conductive layers (not shown) such as Ag thick films or the like are formed on both end surfaces of the respective dielectric resonators 4A and 4B. The conductive layers are soldered onto inner surfaces of the case 3 so as to be electrically connected to the same.

In the crossing portion of the two dielectric resonators 4A and 4B formed in a cross shape, coupling grooves 5 are formed in the top right and bottom left corners thereof so as to have longitudinal lengths each from the front surface of the dielectric resonators 4A and 4B to the back surface thereof, and so as to have depths each extending from two corners of the crossing portion which oppose each other toward the center of the crossing portion in a diagonal direction of the crossing portion. In this case, the coupling grooves 5 are formed so as to cut some of the electric lines Eo of force of the odd mode, and decreases the effective dielectric constant of the odd mode, the electric lines Eo of force of which pass through the coupling grooves 5. Therefore, the coupling grooves 5 make the effective dielectric constant in the even mode of the TM dual mode resonator different from that in the odd mode thereof, and this results in a coupling between the operation modes of the two dielectric resonators 4A and 4B.

In the crossing portion of the TM dual mode dielectric resonator 2, cylindrical projections 6 of the same dielectric ceramic material as that of the dielectric resonators 4A and 4B are formed integrally with the dielectric resonator 2 in the top left and bottom right corners of the crossing portion on the front surface thereof where the electric lines Ee of force of the even mode pass, in another diagonal direction different from the diagonal direction in which the coupling grooves 5 are formed, so as to be capable of being easily cut out from the TM dual mode dielectric resonator 2 one by one if necessary. The projections 6 are provided for adjusting a coupling coefficient $\kappa$ between the dielectric resonators 4A and 4B. When one or more number of projections 6 are cut out or removed, the effective dielectric constant of the odd mode, different from that of the even mode, is increased the electric lines Eo of force of which pass through the coupling grooves 5 and the effective dielectric constant of which is decreased by the coupling grooves 5, and then this results in decrease in the coupling coefficient $\kappa$.

The volumes of the two projections 6 are substantially the same as each other, and the two projections 6 are formed in the positions symmetrically with respect to the center of the crossing portion of the TM dual mode dielectric resonator 2. In this case, the change amount $\Delta\kappa$ in the coupling coefficient when one projection 6 is cut out or removed is the same as that when another projection 6 is cut out or removed, and also the projections 6 are formed so that the above-mentioned change amount $\Delta\kappa$ becomes a predetermined value. Therefore, the adjustment value $\Delta\kappa$ of the coupling coefficient $\kappa$ when one projection 6 is cut out or removed is previously determined or known. Accordingly, when one projection 6 is cut out or removed, the coupling coefficient can be estimated and becomes $(\kappa-\Delta\kappa)$, and further, when two projections 6 are cut out or removed, the coupling coefficient can be estamated and becomes $(\kappa-2\Delta\kappa)$. In other words, the coupling coefficient between the two dielectric resonators 4A and 4B can be set to a desirable coupling coefficient or a coupling coefficient substantially the same as or close to the desirable coupling coefficient, without measuring the coupling coefficient $\kappa$. In this case, even when the coupling coefficient $\kappa$ is finely adjusted thereafter, the adjusting process can be easily performed.

In the present preferred embodiment shown in FIG. 3', the two projections 6 for adjusting the coupling coefficient $\kappa$ are formed. The present invention is not limited to this. A single projection 6 or more than three projections 6 for adjusting the coupling coefficient $\kappa$ may be formed. It is not required that the adjustment amounts $\Delta\kappa$ of the respective projections 6 are the same as each other, and it is required in the present invention that the respective adjustment amounts $\Delta\kappa$ of the projections 6 are previously known or determined. For example, the adjustment amount of the coupling coefficient of one projection 6 may be an integral multiple of that of another projection 6.

In portions of the dielectric resonator 4A other than the crossing portion, such as at an end thereof or the like, through which only the electric lines $E_1$ of force pass, two cylindrical projections 7A of the same dielectric ceramic material as that of the dielectric resonator 4A for adjusting the resonance frequency $f_{01}$ of the dielectric resonator 4A are formed integrally with the dielectric resonator 4A in the center of the top end of the front surface thereof as shown in FIG. 3 where the electric lines $E_1$ of force of the dielectric resonator 4A pass, so as to be capable of being easily cut out or removed from the dielectric resonator 4A one by one if necessary. When one or more projections 7A are cut out or removed, the effective dielectric constant of the dielectric resonator 4A is decreased, and then the resonance frequency $f_{01}$ of the dielectric resonator 4A is heightened.

In the preferred embodiment, the two projections 7A are formed so that the respective volumes thereof are substantially the same as each other. In this case, the adjustment amount $\Delta f_1$ of the resonance frequency $f_{01}$ when one projection 7A is cut out or removed is substantially the same as that when another projection 7A is cut out or removed. The projections 7A are formed so that the adjustment amount $\Delta f_1$ becomes a predetermined value. Therefore, when one projection 7A is cut out or removed, the change amount $\Delta f_1$ in the resonance frequency $f_{01}$ can be estimated. Then when only one projection 7A is cut out or removed, the resonance frequency of the dielectric resonator 4A becomes $(f_{01}+\Delta f_1)$. When two projections 7A are cut out or removed, the resonance frequency of the dielectric resonator 4A becomes $(f_{01}+2\Delta f_1)$.

In a manner similar to that of the projections 7A, in portions of the dielectric resonator 4B other than the crossing portion, such as at an end thereof or the like, through which only the electric lines $E_2$ of force pass, two cylindrical projections 7B of the same dielectric ceramic material as that of the dielectric resonator 4B for adjusting the resonance frequency $f_{02}$ of the dielectric resonator 4B are formed integrally with the dielectric resonator 4B in the center of the right end of the front surface thereof as shown in FIG. 3 where the electric lines $E_2$ of force of the dielectric resonator 4B pass, so as to be capable of being easily cut out or removed from the dielectric resonator 4B one by one if necessary. When one or more projections 7B are cut out or removed, the effective dielectric constant of the dielectric resonator 4B is decreased, and then the resonance frequency $f_{02}$ of the dielectric resonator 4B is heightened.

In the preferred embodiment, the two projections 7B are formed so that the respective volumes thereof are substantially the same as each other. In this case, the adjustment amount $\Delta f_2$ of the resonance frequency $f_{02}$ when one projection 7B is cut out or removed is substantially the same as that when another projection 7B is cut out or removed. The projections 7B are formed so that the adjustment amount $\Delta f_2$ becomes a predetermined value. Therefore, when one projection 7B is cut out or removed, the change amount $\Delta f_2$ in the resonance frequency $f_{02}$ can be estimated. When only one projection 7B is cut out or removed, the resonance frequency of the dielectric resonator 4B becomes $(f_{02}+2\Delta f_2)$. When two projections 7B are cut out or removed, the resonance frequency of the dielectric resonator 4B becomes $(f_{02}+2\Delta f_2)$.

In the present preferred embodiment shown in FIG. 3, the two projections 7A and the two projections 7B for respectively adjusting the respective resonance frequencies are formed. The present invention is not limited to this. One or more than three projections 7A or 7B for adjusting the resonance frequency may be formed. It is not required that the adjustment amounts $\Delta f_1$ or $\Delta f_2$ of the respective projections 7A or 7B are substantially the same as each other, and it is required in the present invention that the respective adjustment amounts $\Delta f_1$ or $\Delta f_2$ of the projections 7A or 7B are previously known or determined. For example, the adjustment amount of the resonance frequency of one projection 7A or 7B may be an integral multiple of that of another projection 7A or 7B, respectively.

According to the preferred embodiments of the present invention, the coupling coefficient between the two dielectric resonators 4A and 4B and/or the resonance frequencies of the two dielectric resonators 4A and 4B can be easily adjusted by predetermined adjustment amounts by respectively cutting out or removing one or more projections 6 for adjusting the coefficients and one or more projections 7A and 7B for adjusting the resonance frequencies in units of the projections 6, 7A and 7B.

In particular, the adjustment amounts of the respective projections 6, 7A and 7B are preferably set to be substantially the same as each other, respectively, or the adjustment amount of the projection 6, 7A or 7B are preferably set to be substantially an integral multiple of that of another projection 6, 7A or 7B. In this case, the coupling coefficient between the two dielectric resonators 4A and 4B and/or the resonance frequencies of the two dielectric resonators 4A and 4B can be easily adjusted by digital amounts.

According to the present invention, the above-mentioned cut-and-try method in which the adjustment and measurement of the resonance frequencies and the coupling coefficient are repeated is not required. This results in decrease in the number of processes of the adjusting procedures for adjusting the coupling coefficient and the resonance frequencies, and also in reduction in the time required for adjusting the same.

In the present preferred embodiment, the coupling grooves 5 are formed in the portions of the crossing portion so as to cut the electric lines Eo of force of the odd mode as shown in FIG. 3, and further the projections 6 are formed on portions of the crossing portions through which the electric lines Ee of force of the even mode pass. However, the present invention is not limited to this. The coupling grooves 5 may be formed in the top left and bottom right portions of the crossing portion so as to cut the electric lines Ee of force of the even mode as shown in FIG. 3, and the projections 6 are formed on the top right and bottom left portions of the crossing portion through which the electric lines Eo of force of the odd mode pass.

In the preferred embodiment, the two coupling grooves 5 are formed respectively in the two corners of the crossing portion of the two dielectric resonator 4A and 4B. However, the present invention is not limited to this. Mode coupling means for coupling an operation mode of the dielectric resonator 4A with that of the dielectric resonator 4B, such as at least one coupling groove 5 or concavity for cutting electric lines Eo or Ee of force of the odd or even mode, may be formed in a portion of the crossing portion in order to cause a coupling between the two dielectric resonators 4A and 4B.

Figure 4:
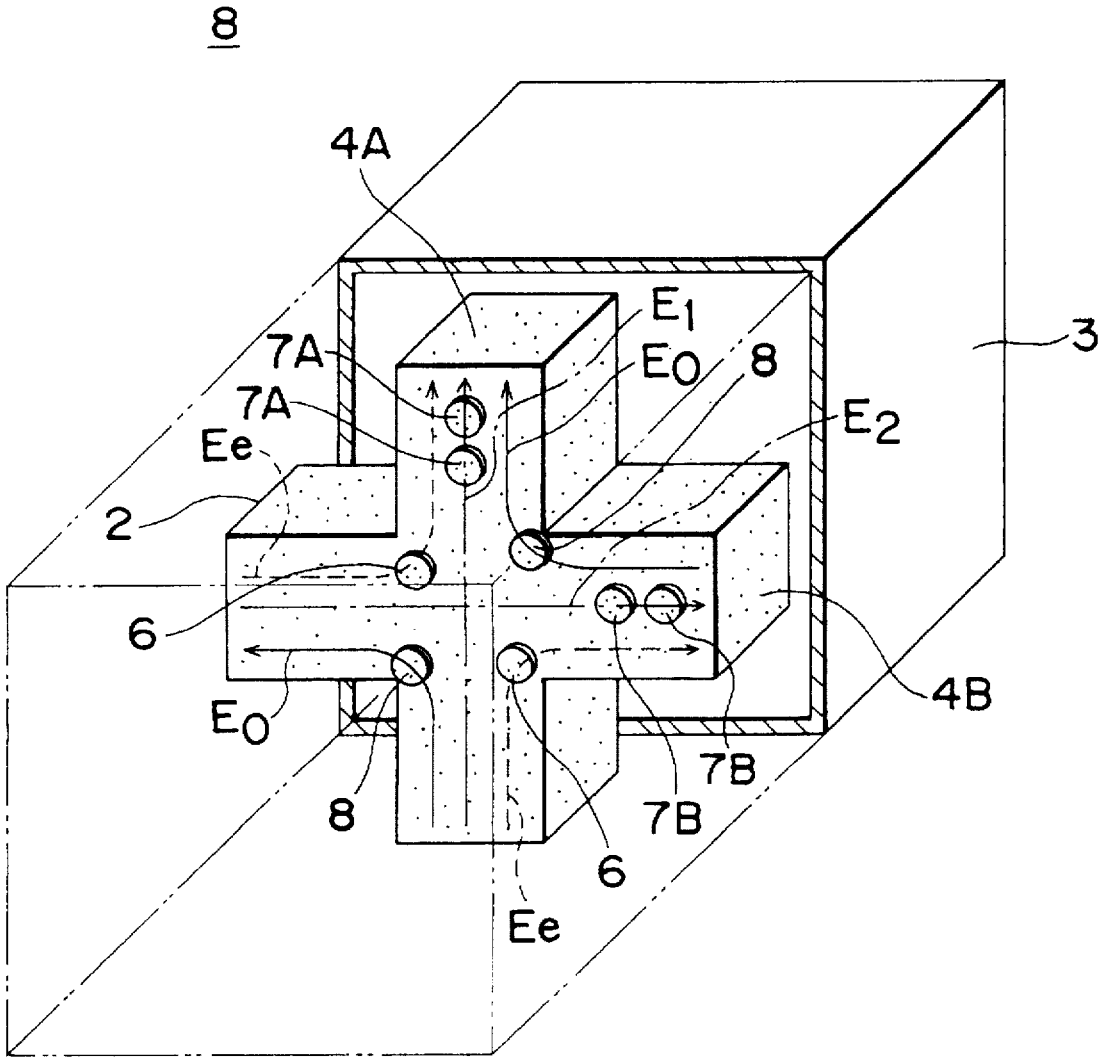
FIG. 4 is a partially broken perspective view of a TM dual mode resonator apparatus according to a further preferred embodiment of the present invention.

Alternatively, instead of the groove 5 or concavity, as shown in FIG. 4, at least one cylindrical projection 8 of the same dielectric ceramic material as that of the dielectric resonators 4A and 4B may be formed as the mode coupling means, integrally with the dielectric resonator 2 in the top right and bottom left corners of the crossing portion on the front surface thereof where the electric lines Eo of force of the odd mode pass. Further, when at least one cylindrical projections 6 of the same dielectric ceramics material as that of the dielectric resonators 4A and 4B are formed integrally with the dielectric resonator 2 in the top left and bottom right corners of the crossing portion on the front surface thereof where the electric lines Ee of force of the even mode pass, at least one cylindrical projection 8 which functions as the mode coupling means may be formed integrally with the dielectric resonator 2 in the top left and bottom right corners of the crossing portion on the front surface thereof where the electric lines Ee of force of the even mode pass.

Alternatively, in order to provide a further mode coupling means, the first and second dielectric resonators 4A and 4B are formed so that the size or area of the end surface of the first dielectric resonator 4A is different from that of the second dielectric resonator 4B.

Alternatively, in order to provide a still further mode coupling means, at least one projection of the same dielectric ceramic material as that of the dielectric resonators 4A and 4B may be formed integrally with the dielectric resonator 2, in a portion of at least one of the four corners of the crossing portion, or extending from the front surface to the back surface in at least one of the four corners of the crossing portion.

Although the present invention has been fully described in connection with the preferred embodiments thereof with reference to the accompanying drawings, it is to be noted that various changes and modifications are apparent to those skilled in the art. Such changes and modifications are to be understood as included within the scope of the present invention as defined by the appended claims unless they depart therefrom.

What is claimed is:

1. A dielectric resonator apparatus comprising:

an electrically conductive case;

a cross-shaped TM dual mode dielectric resonator provided in said case, said TM dual mode dielectric resonator comprising first and second integral dielectric resonators disposed perpendicular to each other and defining a crossing portion at an intersection thereof;

a mode coupler in said TM dual mode dielectric resonator for coupling an operation mode of said first dielectric resonator with an operation mode of said second dielectric resonator; and at least one first projection of a dielectric material for adjusting a coupling coefficient between the first and second dielectric resonators formed integrally together with the first and second dielectric resonators, the coupling coefficient being adjusted by removing, at least in part, said at least one first projection, said at least one first projection representing a defined adjustment amount to the coupling coefficient.

2. The apparatus as claimed in claim 1 wherein said at least one first projection further includes a plurality of first projections each representing a respective adjustment amount to the coupling coefficient, said adjustment amounts represented by said first projections being substantially the same as each other.

3. The apparatus as claimed in claim 1, wherein said at least one first projection further includes a plurality of first projections each representing an adjustment amount to the coupling coefficient, the adjustment amount represented by one of said first projections being substantially an integral multiple of that of another of said first projections.

4. A dielectric resonator apparatus comprising:

an electrically conductive case;

a cross-shaped TM dual mode dielectric resonator provided in said case, said TM dual mode dielectric resonator comprising first and second integral dielectric resonators disposed perpendicularly to each other and defining a crossing portion at an intersection thereof;

a mode coupler in said TM dual mode dielectric resonator for coupling an operation mode of said first dielectric resonator with an operation mode of said second dielectric resonator;

at least one first resonance frequency adjustment projection of a dielectric material for adjusting a resonance frequency of the first dielectric resonator, disposed on a portion of the first dielectric resonator other than the crossing portion of the first and second dielectric resonators, where electric lines of force of the first dielectric resonator pass, said at least one first resonance frequency adjustment projection representing a defined adjustment amount to the resonance frequency of the first dielectric resonator upon removal of the at least one first resonance frequency adjustment projection; and at least one second resonance frequency adjustment projection of a dielectric material for adjusting a resonance frequency of the second dielectric resonator, disposed on a portion of the second dielectric resonator other than the crossing portion of the first and second dielectric resonators, where electric lines of force of the second dielectric resonator pass, said at least one second resonance frequency adjustment projection representing a defined adjustment amount to the resonance frequency of the second dielectric resonator upon removal of the at least one second resonance frequency adjustment projection.

5. The apparatus as claimed in claim 4, wherein said at least one first resonance frequency adjustment projection further includes a plurality of first resonance frequency adjustment projections each representing respective adjustment amounts to the resonance frequency of the first dielectric resonator, said adjustment amounts represented by said first resonance frequency adjustment projections being substantially the same as each other, and wherein said at least one second resonance frequency adjustment projection further includes a plurality of second resonance frequency adjustment projections each representing respective adjustment amounts to the resonance frequency of the second dielectric resonator, said adjustment amounts represented by said second resonance frequency adjustment projections being substantially the same as each other.

6. The apparatus as claimed in claim 4, wherein said at least one first resonance frequency adjustment projection further includes a plurality of first resonance frequency adjustment projections each representing an adjustment amount to the resonance frequency of said first dielectric resonator, the adjustment amount represented by one of said first resonance frequency adjustment projections being substantially an integral multiple of that of another of said first resonance frequency adjustment projections and, wherein said at least one second resonance frequency adjustment projection further includes a plurality of second resonance frequency adjustment projections each representing an adjustment amount to the resonance frequency of the second dielectric resonator, the adjustment amount represented by one of said second resonance frequency adjustment projections being substantially an integral multiple of that of another of said second resonance frequency adjustment projections.

7. A dielectric resonator apparatus comprising:

an electrically conductive case;

a cross shaped TM dual mode dielectric resonator provided in said case, said TM dual mode dielectric resonator comprising first and second integral dielectric resonators disposed perpendicular to each other and defining a crossing portion at an intersection thereof;

a mode coupler in said TM dual mode dielectric resonator for coupling an operation mode of said first dielectric resonator with an operation mode of said second dielectric resonator;

at least one first projection of a dielectric material for adjusting a coupling coefficient between the first and second dielectric resonators disposed on a portion of the crossing portion of the first and second dielectric resonators, said at least one first projection representing a defined adjustment amount to the coupling coefficient upon removal of the at least one first projection;

at least one first resonance frequency adjustment projection of a dielectric material for adjusting a resonance frequency of the first dielectric resonator, disposed on a portion of the first dielectric resonator other than the crossing portion of the first and second dielectric resonators, where electric lines of force of the first dielectric resonator pass, said at least one first resonance frequency adjustment projection representing a defined adjustment amount to the resonance frequency of the first dielectric resonator upon removal of the at least one first resonance frequency adjustment projection; and at least one second resonance frequency adjustment projection of a dielectric material for adjusting a resonance frequency of the second dielectric resonator, disposed on a portion of the second dielectric resonator other than the crossing portion of the first and second dielectric resonators, where electric lines of force of said second dielectric resonator pass, said at least one second resonance frequency adjustment projection representing a defined adjustment amount to the resonance frequency of the second dielectric resonator upon removal of the at least one second resonance frequency adjustment projection.

8. The apparatus as claimed in claim 7, wherein said at least one first projection further includes a plurality of first projections each representing respective adjustment amounts to the coupling coefficient, said adjustment amounts represented by said first projections being substantially the same as each other;

wherein said at least one first resonance frequency adjustment projection further includes a plurality of first resonance frequency adjustment projections each representing respective adjustment amounts to the resonance frequency of the first dielectric resonator, said adjustment amounts represented by said first resonance frequency adjustment projections being substantially the same as each other; and wherein said at least one second resonance frequency adjustment projection further includes a plurality of second resonance frequency adjustment projections each representing respective adjustment amounts to the resonance frequency of said second dielectric resonator, said adjustment amounts represented by said second resonance frequency adjustment projections being substantially the same as each other.

9. The apparatus as claimed in claim 7, wherein said at least one first projection further includes a plurality of first projections, each representing an adjustment amount to the coupling coefficient, the adjustment amount represented by one of said first projections being substantially an integral multiple of that of another of said first projections;

wherein said at least one first resonance frequency adjustment projection further includes a plurality of first resonance frequency adjustment projections, each representing an adjustment amount to the resonance frequency of said first dielectric resonator, the adjustment amount represented by one of said first resonance frequency adjustment projections being substantially an integral multiple of that of another of said first resonance frequency adjustment projections; and wherein said at least one second resonance frequency adjustment projection further includes a plurality of second resonance frequency adjustment projections, each representing an adjustment amount to the resonance frequency of said second dielectric resonator, the adjustment amounts represented by one of said second resonance frequency adjustment projections being substantially an integral multiple of that of another of said second resonance frequency adjustment projections.

10. A method for adjusting a coupling coefficient between first and second dielectric resonators of a cross-shaped TM dual mode dielectric resonator of a dielectric resonator apparatus, said cross-shaped TM dual mode dielectric resonator provided in an electrically conductive case, said TM dual mode dielectric resonator comprising the first and second dielectric resonators integrally formed perpendicular to each other and defining a crossing portion at an intersection thereof, the method comprising:

providing a mode coupler coupling an operation mode of the first dielectric resonator with an operation mode of the second dielectric resonator;

providing at least one first projection of a dielectric material for adjusting a coupling coefficient between the first and second dielectric resonators on a portion of the crossing portion of the first and second dielectric resonators, the at least one first projection representing a defined adjustment amount to the coupling coefficient upon removal of the at least one first projection; and further comprising:

removing said at least one first projection to adjust the coupling coefficient between the first and second dielectric resonators.

11. The method as claimed in claim 10 further comprising providing a plurality of first projections including said at least one projection each representing respective adjustment amounts to the coupling coefficient, said adjustment amounts represented by the first projections being substantially the same as each other.

12. The method as claimed in claim 10 further comprising the step of:

providing a plurality of first projections including said at least one projection each representing an adjustment amount to the coupling coefficient, the adjustment amount represented by one of said first projections being substantially an integral multiple of that of another of said first projections.

13. A method for adjusting resonance frequencies of first and second dielectric resonators of a cross-shaped TM dual mode dielectric resonator of a dielectric resonator apparatus, said cross-shaped TM dual mode dielectric resonator provided in an electrically conductive case, said TM dual mode dielectric resonator comprising the first and second dielectric resonators integrally formed perpendicular to each other and defining a crossing portion at an intersection thereof, the method comprising:

providing a mode coupler for coupling an operation mode of the first dielectric resonator with an operation mode of the second dielectric resonator;

providing at least one first resonance frequency adjustment projection of a dielectric material for adjusting the resonance frequency of the first dielectric resonator on a portion of the first dielectric resonator other than the crossing portion of the first and second dielectric resonators, where electric lines of force of the first dielectric resonator pass, said first at least one resonance frequency adjustment projection representing a defined adjustment amount to the resonance frequency of the first dielectric resonator upon removal of the at least one first resonance frequency adjustment projection; and providing at least one second resonance frequency adjustment projection of a dielectric material for adjusting a resonance frequency of the second dielectric resonator on a portion of the second dielectric resonator other than the crossing portion of the first and second dielectric resonators, where electric lines of force of the second dielectric resonator pass, said at least one second resonance frequency adjustment projection representing a defined adjustment amount to the resonance frequency of the second dielectric resonator upon removal of the second at least one resonance frequency adjustment projection;

removing said at least one first resonance frequency adjustment projection, thereby adjusting the resonance frequency of the first dielectric resonator; and removing said at least one second resonance frequency adjustment projection, thereby adjusting the resonance frequency of the second dielectric resonator.

14. The method as claimed in claim 13, further comprising providing:

a plurality of first resonance frequency adjustment projections including said at least one first resonance frequency adjustment projection each representing respective adjustment amounts to the resonance frequency of the first dielectric resonator, said adjustment amounts represented by said first resonance frequency adjustment projections being substantially the same as each other; and providing a plurality of second resonance frequency adjustment projections including said at least one second resonance frequency adjustment projection each representing adjustment amounts to the resonance frequency of the second dielectric resonator, said adjustment amounts represented by the second resonance frequency adjustment projections being substantially the same as each other.

15. The method as claimed in claim 13, further comprising:

providing a plurality of first resonance frequency adjustment projections including said at least one first resonance frequency adjustment projection each representing an adjustment amount to the resonance frequency of said first dielectric resonator, the adjustment amounts represented by one of said first resonance frequency adjustment projections being substantially an integral multiple of that of another of said first resonance frequency adjustment projections; and providing a plurality of second resonance frequency adjustment projections including said at least one second resonance frequency adjustment projection each representing an adjustment amount to the resonance frequency of said second dielectric resonator, the adjustment amount represented by one of said second resonance frequency adjustment projections being substantially an integral multiple of that of another of said second resonance frequency adjustment projections.

16. A dielectric resonator apparatus comprising:

an electrically conductive case;

a cross-shaped TM dual mode dielectric resonator provided in said case, said TM dual mode dielectric resonator comprising first and second integral dielectric resonators disposed perpendicular to each other and defining a crossing portion at an intersection thereof and further defining a planar surface common to said first and second integral dielectric resonators;

a mode coupler in said TM dual mode dielectric resonator for coupling an operation mode of said first dielectric resonator with an operation mode of said second dielectric resonator; and at least one first projection of a dielectric material for adjusting a coupling coefficient between the first and second dielectric resonators extending from the planar surface common to the first and second dielectric resonators, the coupling coefficient being adjusted by removing, at least in part, said at least one first projection, said at least one first projection representing a defined adjustment amount to the coupling coefficient.

17. The apparatus of claim 16, wherein said at least one projection extends perpendicularly from said planar surface.

* * * * *